US012303004B2

(12) United States Patent
McCamy et al.

(10) Patent No.: US 12,303,004 B2
(45) Date of Patent: May 20, 2025

(54) CARD CLASP FOR WEARING COLLECTIBLE CARDS

(71) Applicants: Christopher Ryan McCamy, Frederick, MD (US); Sara Maria McCamy, Sandviken (SE)

(72) Inventors: Christopher Ryan McCamy, Frederick, MD (US); Sara Maria McCamy, Sandviken (SE)

( * ) Notice: Subject to any disclaimer, the term of this patent is extended or adjusted under 35 U.S.C. 154(b) by 619 days.

(21) Appl. No.: 17/500,589

(22) Filed: Oct. 13, 2021

(65) Prior Publication Data

US 2022/0125173 A1 Apr. 28, 2022

Related U.S. Application Data

(60) Provisional application No. 63/105,458, filed on Oct. 26, 2020.

(51) Int. Cl.
*A45C 11/18* (2006.01)
*A45F 5/00* (2006.01)

(52) U.S. Cl.
CPC ..... *A45C 11/18* (2013.01); *A45F 5/00* (2013.01); *A45F 2005/006* (2013.01); *A45F 5/155* (2025.01)

(58) Field of Classification Search
CPC ..... A45C 11/18; A45F 5/00; A45F 2005/006; A45F 2200/055
USPC ..... 150/147
See application file for complete search history.

(56) References Cited

U.S. PATENT DOCUMENTS

| | | | | |
|---|---|---|---|---|
| 4,744,497 | A * | 5/1988 | O'Neal | A45C 1/06 150/147 |
| 5,159,964 | A * | 11/1992 | Baker | B42F 5/04 150/147 |
| 5,461,810 | A * | 10/1995 | Goserud | G09F 3/20 40/661 |
| 6,681,972 | B1 | 1/2004 | Tapocik | |
| 6,752,305 | B2 | 6/2004 | Shattuck | |
| 7,257,967 | B2 | 8/2007 | Rheinstein | |
| 8,832,976 | B1 | 9/2014 | Arabian et al. | |
| 9,173,474 | B2 | 11/2015 | Winterburg | |
| 9,548,005 | B2 | 1/2017 | Willoughby | |
| D917,879 | S | 5/2021 | Chui | |
| 2001/0054245 | A1 | 12/2001 | Williams | |

(Continued)

FOREIGN PATENT DOCUMENTS

| | | | |
|---|---|---|---|
| GB | 258432 | 9/1926 | |
| WO | WO-2008119076 A1 * | 10/2008 | A45C 11/182 |

OTHER PUBLICATIONS https://www.youtube.com/watch?v=wrp5RgQfTXE by Randolph (Year: 2020).*

(Continued)

*Primary Examiner* — Nathan J Jenness
*Assistant Examiner* — Jessica Kavini Tamil
(74) *Attorney, Agent, or Firm* — NIXON & VANDERHYE P.C.

(57) ABSTRACT

A wearable trading card clasp protective case includes a backing section and a window section having a top, bottom and sides. The bottom and sides are secured on the backing section thereby defining a slot between the top and the backing section. A removable barrier is selectively positionable over the slot.

15 Claims, 4 Drawing Sheets

(56) References Cited

U.S. PATENT DOCUMENTS

| | | | | |
|---|---|---|---|---|
| 2005/0023316 | A1* | 2/2005 | Anderson | A45F 5/00 224/607 |
| 2005/0262748 | A1* | 12/2005 | Curtis | G09F 3/14 40/586 |
| 2006/0150464 | A1 | 7/2006 | Lindsey | |

OTHER PUBLICATIONS

Amazon 5 Pack—Premium 2 Card ID Badge Holders, https://www.amazon.com/Premium-Badge-Holder-Pack-Horizontal/dp/B017DU9630, website pages, printed out on Oct. 13, 2021, origination date unknown, 9 pp.

Amazon Advantus Horizontal ID Card Holders, https://www.amazon.com/Advantus-Horizontal-Card-Holders-Black/do/B00U1HPOJ4, website pages, printed out on Oct. 13, 2021, origination date unknown, 5 pp.

Idsuperstore, Black Vertical Open-Face Semi-Rigid Card Holder, https://www.idsuperstore.com/black-vertical-colored-open-face-multi-card-holder?gclid=EAIaIQobChMIncvwy4G28QIV0DizABmBgQHEAOYBSABEgL0afD_BwE, website pages, printed out on Oct. 13, 2021, origination date unknown, 2 pp.

IDWholesaler Black Rigid Plastic Badge Holder, https://www.idwholesaler.com/1840-3081-PLA.html ?_ bt=83787381558&_bk=&_bm=&_bn=g&creative=83787381558&keyword=&matchtype=&network=g&device=c&offer_id=1840-3081&gclid=EAIaIQobChMI712rkM2z8QIVZ21vBB28DwNXEAQYASABEgLaRfD_BwE, website pages, printed out on Oct. 13, 2021, origination date unknown, 2 pp.

* cited by examiner

FIG. 1a
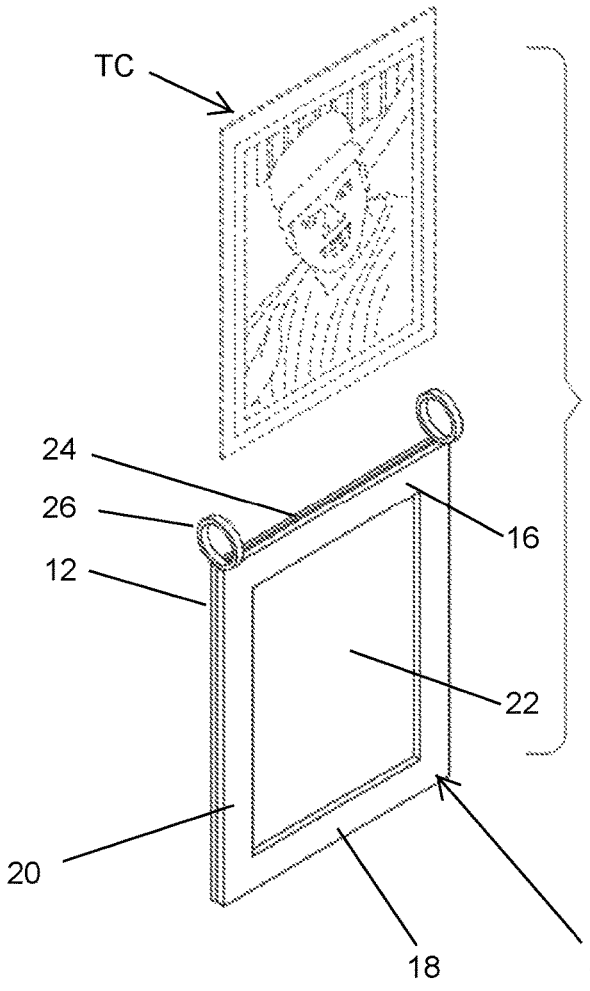
FIG. 1b
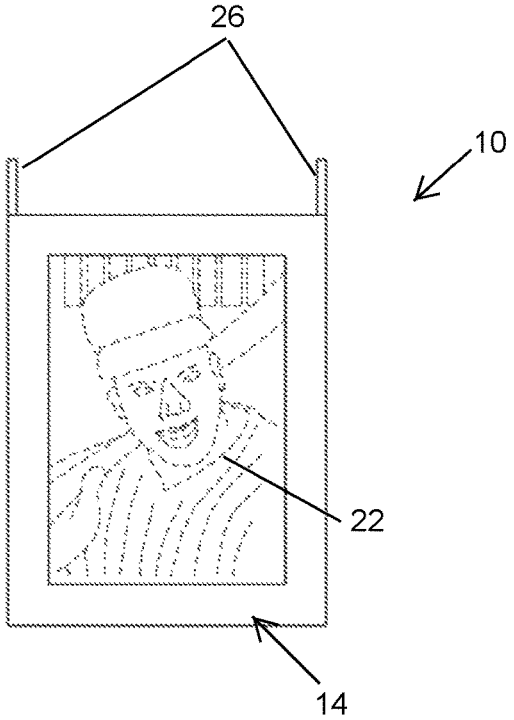
FIG. 1

CARD CLASP FOR WEARING COLLECTIBLE CARDS

CROSS-REFERENCES TO RELATED APPLICATIONS

This application claims the benefit of U.S. Provisional Patent Application No. 63/105,458, filed Oct. 26, 2020, the entire content of which is herein incorporated by reference.

STATEMENT REGARDING FEDERALLY SPONSORED RESEARCH OR DEVELOPMENT (NOT APPLICABLE)

BACKGROUND

The invention relates to collectible cards and, more particularly, to assemblies for enabling card owners to display/wear their favorite cards, slabs, stickers or the like as a fashion statement.

Collectable cards have been popular to different degrees over the years. These cards are currently gaining in popularity, and getting a card authenticated and "Slabbed" is significant. Basketball cards are particularly popular, and even rare Pokemon® cards are being sold for significant sums. There exist various online platforms for buying and selling collectible cards.

Currently, however, there is no convenient and fashionable way to wear these collectible cards around your neck in tandem with a necklace.

SUMMARY

It would be desirable to provide a wearable display piece that can display a card owner's favorite card(s) while protecting the card(s) from damage or theft. Reference in the present description to "cards" is intended to encompass trading cards, slabs (graded card slabs or display slabs), stickers, postcards, LED-displayed non-fungible tokens (NFTs), penny sleeves (soft plastic case), toploader (hard plastic case), etc. For example, teens and adults may want to wear their Lebron James trading card the night after he scores 56 points to win the playoff game, while another collector may want to display the newest foil Pokemon® card they pulled out of the pack the night before.

Various embodiments may be envisioned to achieve the intended objectives. The display piece will include a transparent, open faced, or semi-transparent window through which the card is viewable. The window will be part of some form of container or casing that protects the card.

In an exemplary embodiment, a wearable trading card clasp protective case includes a backing section and a window section having a top, bottom and sides. The bottom and sides are cooperable with the backing section to define a slot between the top and the backing section. A removable barrier is selectively positionable over the slot.

The removable barrier may be a necklace. The case may further include necklace eyelets disposed at top corners of the protective case adjacent the slot, where the necklace is threaded through the necklace eyelets and positioned over the slot.

The backing section and the window section may be formed as a single integral piece. The case may include eyelets disposed at top corners of the protective case that receive the removable barrier. In some embodiments, the eyelets are integral with the backing section and the window section.

The window section may include an opening and a transparent or semi-transparent material covering the opening.

The case may also include a protector sleeve positioned between the backing section and the window section, where the protector sleeve has a top opening that is coincident with the slot. The protector sleeve may be removable.

The backing section and the window section may be constructed of plastic, leather, silicone, metal or other suitable materials.

In another exemplary embodiment, a trading card necklace includes a protective case with a backing section and a window section having a top, bottom and sides. The bottom and sides of the window section are positioned over the backing section and define a slot between the top and the backing section. A necklace holder is affixed to the protective case and positioned adjacent outer ends of the slot. A necklace is disposed in the necklace holder and positioned over the slot.

BRIEF DESCRIPTION OF THE DRAWINGS

These and other aspects and advantages will be described in detail with reference to the accompanying drawings, in which:

FIG. 1 is a front view of a wearable trading card clasp protective case of the described embodiments;

FIGS. 1*a* and 1*b* show a trading card positioned for insertion into the trading card clasp protective case;

DETAILED DESCRIPTION

Figure 2:
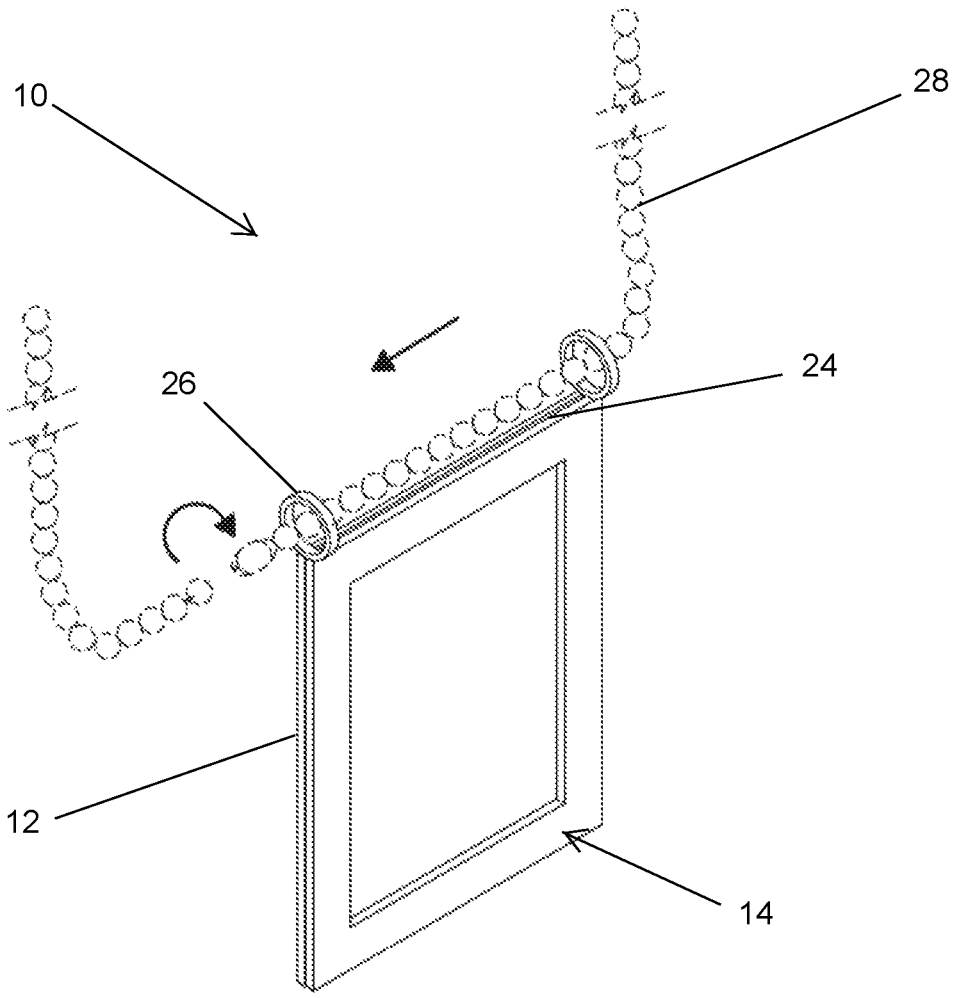
FIG. 2 shows a necklace extending through necklace eyelets on the protective case.
Figure 3:
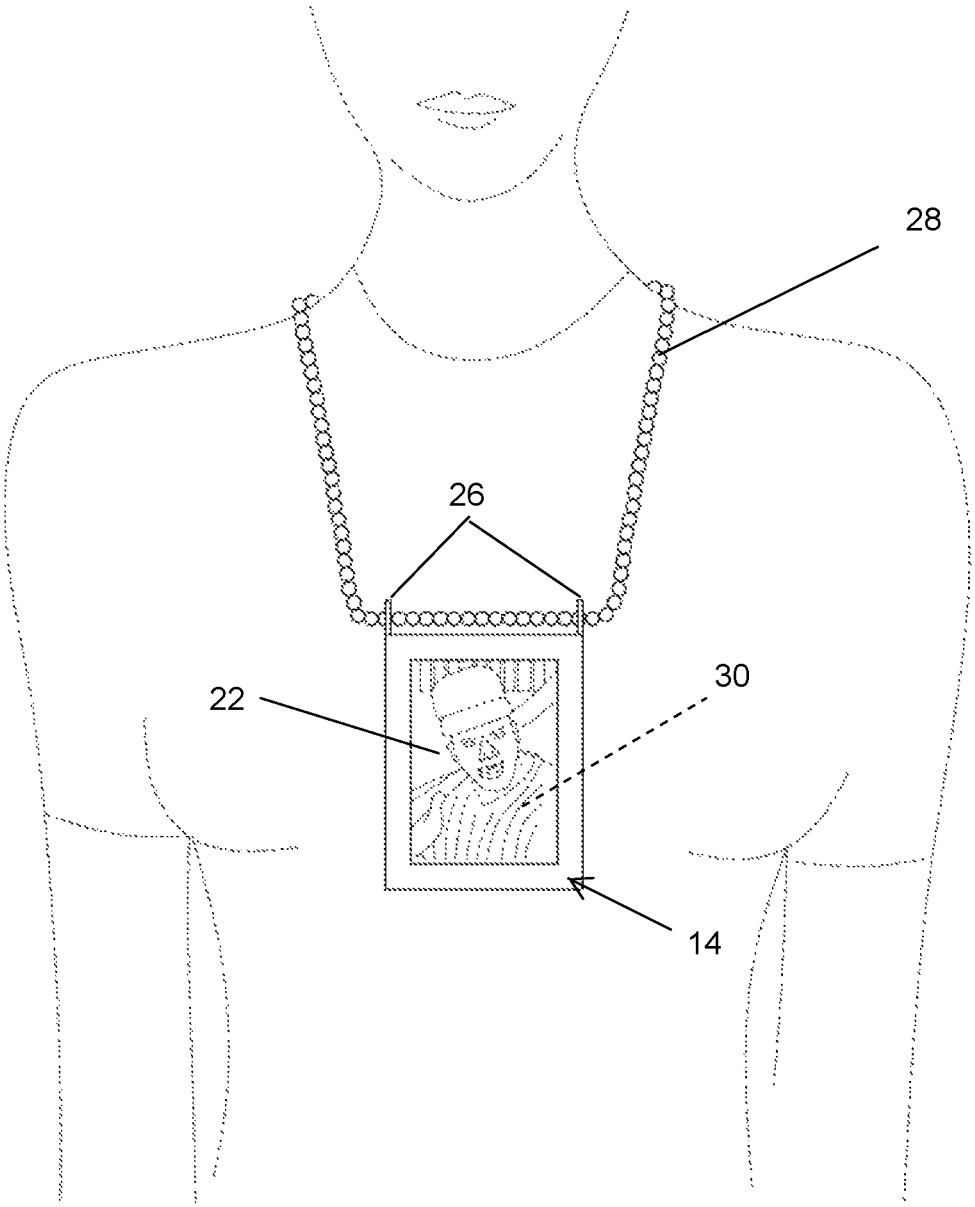
FIG. 3 shows an exemplary use of the trading card clasp protective case.

With reference to FIGS. 1, 1*a* and 1*b*, a wearable trading card clasp protective case 10 includes a backing section 12 and a window section 14 having a top 16, bottom 18, and sides 20. The window section 14 defines an opening 22. A slot 24 is defined between the top 16 and the backing section 12.

In some embodiments, the bottom 18 and sides 20 of the window section 14 are secured on the backing section 12 via an adhesive or the like. The case 10 may be formed of plastic, leather, metal, silicone or the like. With some materials, the bottom 18 and sides 20 may be sewn or welded to the backing section 12. Alternatively, the backing section 12 and the window section 14 may be constructed as a single integral piece. The single piece construction may be formed via a 3D printer, a molding process, or some other suitable process. In a 3D printed embodiment, molten plastic is extruded through a nozzle under computer control. The backing section 12 may be laid first, followed by the bottom 18 and sides 20 of the window section 14. In order to create the slot 24 between the top 16 and the backing section 12, posts are formed on the backing section 12, and the top 16 is laid across the posts, and the top 16, bottom 18 and sides 20 are finished flush. Using proper material, the top 16 remains spaced from the backing section 12 as the material for the top 16 is extruded across the posts.

As shown, necklace eyelets 26 are disposed at top corners of the protective case 10 adjacent the slot 24. The necklace eyelets 26 may be attached to or integrated with the backing section 12 or the window section 14 or both. In the 3D printed embodiment, the eyelets 26 are formed in layers and integrated with the top 16 and backing section 12.

With reference to FIG. 2, a removable barrier in the form of a necklace 28 or the like is selectively positionable over the slot 24. Specifically, the necklace 28 may be threaded through the necklace eyelets 26 and positioned over the slot 24. In this manner, the necklace 28 serves as a barrier to prevent the trading card(s) (slab(s), sticker(s), NFT(s)) TC from inadvertently falling from the protective case. The slot 24 itself may generally be narrow enough to prevent the trading card(s) TC from falling out, e.g., by friction.

NFTs may be in the form of an electronic card with an LED display. The electronic card/LED display is securable in the trading card clasp protective case 10 in the same manner as the trading card(s).

Figure 4:
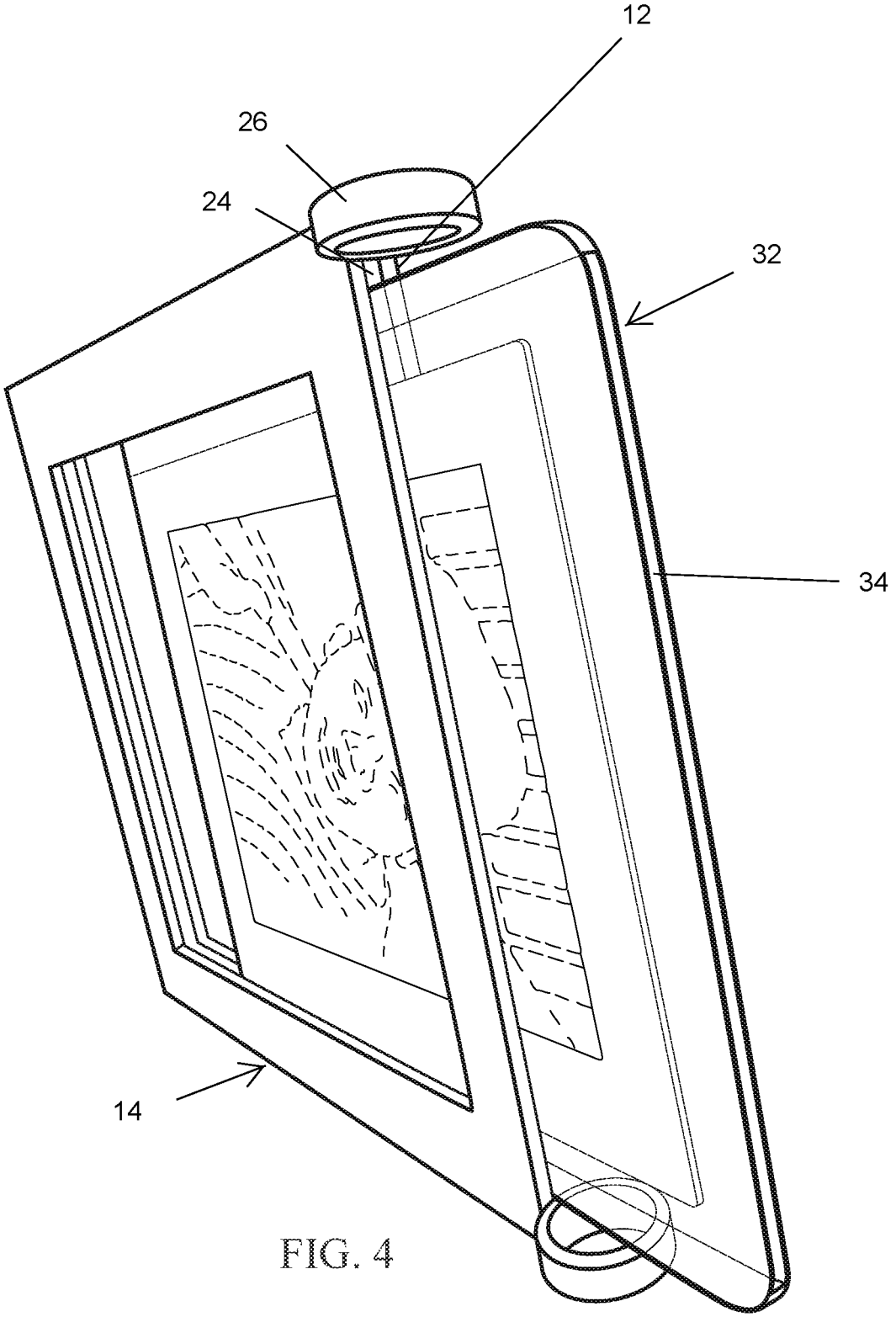
FIG. 4 shows a protective sleeve inserted into the trading card clasp protective case.

In some embodiments, a transparent or semi-transparent material 30 may be interposed between the backing section 12 and the window section 14 to cover the opening 22. Alternatively, with reference to FIG. 4, the protective case may additionally be provided with a protector sleeve 32 positioned between the backing section 12 and the window section 14. As shown, the protector sleeve 32 includes a top opening 34 that is coincident with the slot 24. Preferably, the protector sleeve 32 is removable.

The described embodiments enable card owners to wear their trading card "art piece" around their neck while securing and protecting their card(s)/slab(s) from various elements such as chipping, creasing, dropping, etc. The trading card necklace can serve to stylize their card(s) and enable the card owner to swap out different cards in cases and/or slabs.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A wearable trading card clasp protective case comprising:

a backing section;

a window section having a top, bottom and sides, wherein the bottom and sides are cooperable with the backing section to define a slot between the top and the backing section; and a removable barrier selectively positionable directly over the slot such that the barrier is positionable to prevent a trading card in the protective case from coming out of the protective case through the slot, wherein the removable barrier comprises a necklace that extends in a lengthwise dimension along the slot, covering a majority of the slot.

2. A wearable trading card clasp protective case according to claim 1, further comprising necklace eyelets disposed at top outermost corners of the protective case adjacent the slot, wherein the necklace is threaded through the necklace eyelets and positioned directly over the slot.

3. A wearable trading card clasp protective case according to claim 1, wherein the backing section and the window section are formed as a single piece.

4. A wearable trading card clasp protective case according to claim 3, further comprising eyelets disposed at top outermost corners of the protective case, the eyelets receiving the removable barrier.

5. A wearable trading card clasp protective case according to claim 4, wherein the eyelets are formed as part of a single piece with the backing section and the window section.

6. A wearable trading card clasp protective case according to claim 1, wherein the window section comprises an opening.

7. A wearable trading card clasp protective case according to claim 1, further comprising a protector sleeve positioned between the backing section and the window section, the protector sleeve including a top opening that is coincident with the slot when the protector sleeve is fully inserted between the backing section and the window section.

8. A wearable trading card clasp protective case according to claim 7, wherein the protector sleeve is removable.

9. A wearable trading card clasp protective case according to claim 1, wherein the backing section and the window section are constructed of plastic.

10. A wearable trading card clasp protective case according to claim 1, wherein the backing section and the window section are constructed of leather, silicone or metal.

11. A trading card necklace comprising:

a protective case including a backing section and a window section having a top, bottom and sides, wherein the bottom and sides of the window section are positioned over the backing section thereby defining a slot between the top and the backing section;

a necklace holder affixed to the protective case and positioned adjacent outer ends of the slot; and a necklace disposed in the necklace holder and positioned directly over and along the slot and covering a majority of the slot such that the necklace defines a barrier for preventing a trading card from being displaced through the slot.

12. A trading card necklace according to claim 11, wherein the necklace holder comprises a pair of necklace eyelets disposed at top corners of the protective case.

13. A trading card necklace according to claim 11, wherein the window section comprises an opening.

14. A trading card necklace according to claim 11, further comprising a protector sleeve positioned between the backing section and the window section, the protector sleeve including a top opening that is coincident with the slot when the protector sleeve is fully inserted between the backing section and the window section.

15. A trading card necklace according to claim 14, wherein the protector sleeve is removable.

* * * * *